US005913413A

United States Patent [19]

Huyck

[11] Patent Number: 5,913,413

[45] Date of Patent: Jun. 22, 1999

[54] LINGERIE STRAP CUSHIONING DEVICE

[76] Inventor: Mary F. Huyck, 1126 North Ave., Elizabeth, N.J. 07201

[21] Appl. No.: 09/089,077

[22] Filed: Jun. 2, 1998

[51] Int. Cl.[6] ..... A41D 27/26

[52] U.S. Cl. ..... 2/459; 2/268

[58] Field of Search ..... 2/267, 268, 23, 2/24, 22, 459, 460, 461, 46

[56] References Cited

U.S. PATENT DOCUMENTS

| | | |
|---|---|---|
| D. 360,745 | 8/1995 | Nicholson . |
| 4,575,874 | 3/1986 | Johnson . |
| 4,612,935 | 9/1986 | Greifer . |
| 4,795,399 | 1/1989 | Davis . |
| 4,945,576 | 8/1990 | Melton . |
| 5,201,078 | 4/1993 | Melton . |

*Primary Examiner*—Gloria Hale
*Attorney, Agent, or Firm*—Goldstein & Canino

[57] ABSTRACT

A lingerie strap cushioning device, for use by a woman having shoulders, when wearing an article of lingerie having shoulder straps, comprising an upper section and a lower section that are separated by a fold line. The upper section and lower section are normally coplanar, but are selectively foldable about the fold line to trap one of the lingerie straps therebetween. The cushioning device has a bottom curve which is symmetrical about the fold line. The cushioning device also has a top curve which intersects the fold line at a point of intersection, and is concave outward from the point of intersection with the fold line. When the cushioning device is folded about the fold line, the bottom curve overlaps the upper portion and lower portion, but the upper portion defines an extension section in the lower portion where the upper portion does not overlap the lower portion.

4 Claims, 2 Drawing Sheets

LINGERIE STRAP CUSHIONING DEVICE

BACKGROUND OF THE INVENTION

The invention relates to a lingerie strap cushioning device. More particularly, the invention relates to a device which attaches around the shoulder straps of a brassiere or the like, to increase the weight distribution therefrom at the shoulders of the wearer, and thus enhance the comfort thereof.

Conventional lingerie, most notably brassieres, have shoulder straps which support the majority of the weight of a woman's breasts. For full-figured women, this weight can be considerable. Commonly, many of these woman suffer from back problems, and other health problems due to this weight. Additionally, the straps themselves can cause stress and pain. By their nature, the straps exert the entire weight upon a very small surface area of the shoulders. Thus, through the course of the day, the bra straps begin to cut into the shoulders. In fact, once the bra is removed, a bruise-like impression left by the bra straps might remain visible for several hours.

Several have proposed shoulder pad type bra strap pads. U.S. Pat. Nos. 5,201,078 to Melton; 4,945,576 to Melton; 4,795,399 to Davis; 4,575,874 to Johnson; and 4,612,935 to Greifer, each disclose different shoulder pads for supporting bra straps.

While these units may be suitable for the particular purpose employed, or for general use, they would not be as suitable for the purposes of the present invention as disclosed hereafter.

SUMMARY OF THE INVENTION

It is an object of the invention to produce a lingerie strap cushion which enhances the comfort of the lingerie strap by increasing the weight distribution area upon the shoulders.

It is another object of the invention to produce a lingerie strap cushion which works in conjunction with pre-existing lingerie. The device secures to the lingerie strap, and provides a cushioning effect beneath the strap.

It is a further object of the invention to produce a lingerie strap cushion which conforms to the contours of the shoulder so that it does not create a bulky protuberance at the shoulder.

It is a still further object of the invention to provide a lingerie strap which is simple in construction, so that it is inexpensive to manufacture.

The invention is a lingerie strap cushioning device, for use by a woman having shoulders, when wearing an article of lingerie having shoulder straps, comprising an upper section and a lower section that are separated by a fold line. The upper section and lower section are normally coplanar, but are selectively foldable about the fold line to trap one of the lingerie straps therebetween. The cushioning device has a bottom curve which is symmetrical about the fold line. The cushioning device also has a top curve which intersects the fold line at a point of intersection, and is concave outward from the point of intersection with the fold line. When the cushioning device is folded about the fold line, the bottom curve overlaps the upper portion and lower portion, but the upper portion defines an extension section in the lower portion where the upper portion does not overlap the lower portion.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
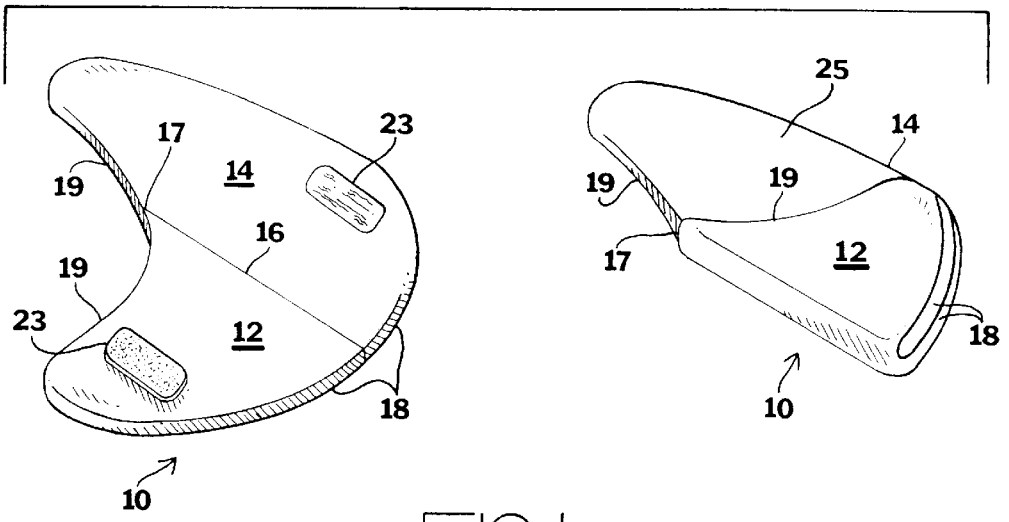
FIG. 1 is a diagrammatic perspective view, illustrating a preferred embodiment of the invention, both open and closed.

FIG. 1 illustrates a preferred embodiment of a lingerie cushion 10. The cushion 10 includes a lower portion 12 and an upper portion 14, which are separated by a fold line 16. The upper portion 14 and lower portion 12 are normally coplanar, but are selectively foldable about the fold line 16. The lower portion 12 and upper portion 14 each have a bottom curve 18 which is symmetrical about the fold line 16, so that when the lower portion 12 is folded to the upper portion 14, the bottom curves 18 correspond with each other.

The lower portion and upper portion 14 have a top curve 19 which intersects the fold line 16 at an intersection point 17. The top curve 19 is concave outward from the point of intersection 17. Thus, the lower portion 12 is folded to the upper portion 14, an extension section 25 of the lingerie cushion 10 is formed, which is a portion of the lower portion 12 which is not overlapped by the upper portion 14.

A fastening device, comprises fastening device components 23 which are present on both the lower portion 12 and upper portion 14. When the upper portion 14 is folded with respect to the lower portion 12, the fastening device selectively secures the upper portion 14 to the lower portion. The fastening device also selectively releases the upper portion 14 from the lower portion 12 when sufficient force is exerted thereupon to release the fastening device components 23 from each other. Preferably, the fastening device is a hook and loop fastener, comprising hook and loop fastener components. Of course, other fastening devices may be used, including snaps, adhesives, buttons, and the like, as would be appreciated by one of ordinary skill in the art.

Figure 2:
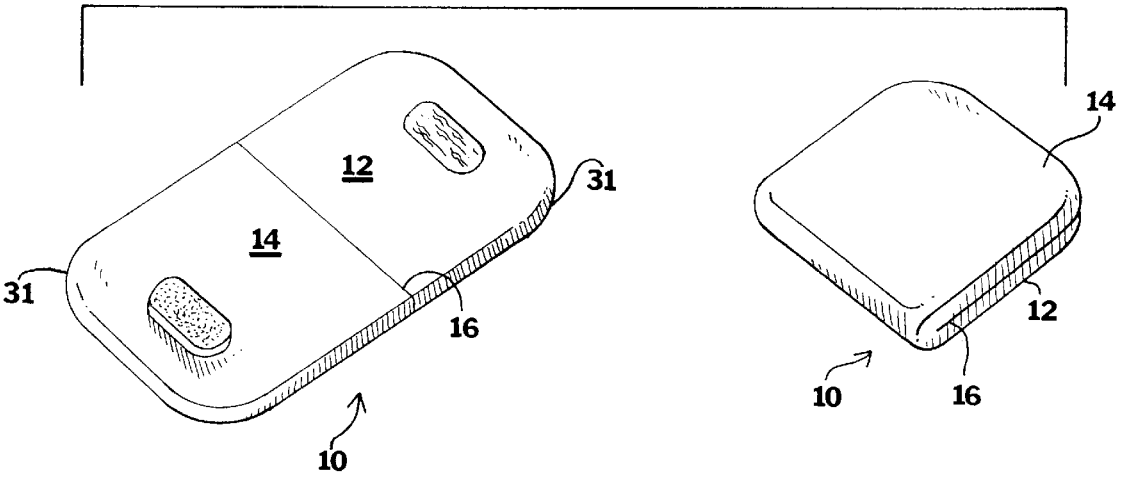
FIG. 2 is a diagrammatic perspective view, illustrating another embodiment of the invention, both open and closed.
Figure 3:
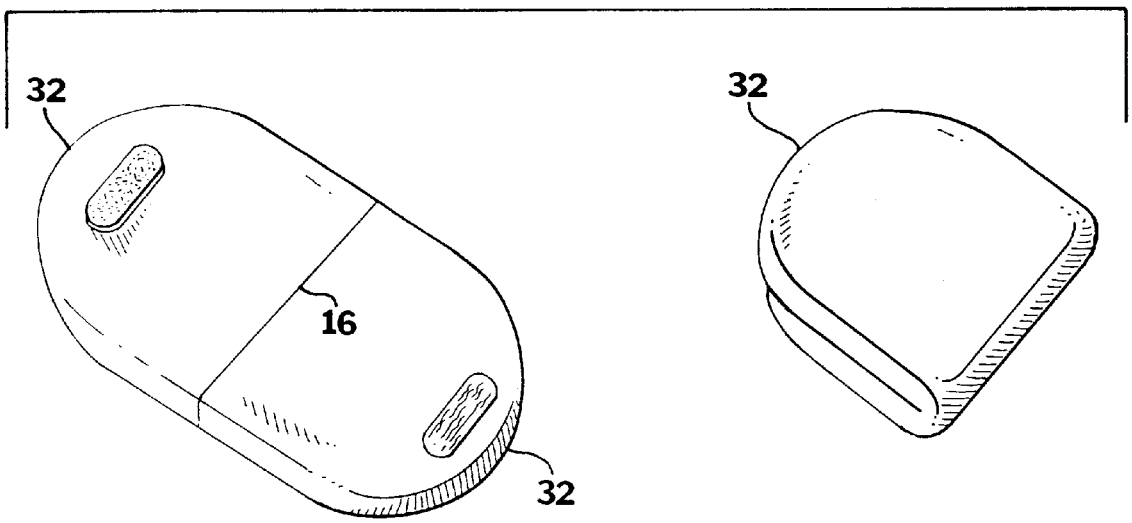
FIG. 3 is a diagrammatic perspective view, illustrating a further embodiment of the invention, both open and closed.

FIG. 2 and FIG. 3 illustrate alternate embodiments of the lingerie cushion 10, wherein the lower portion 12 and upper portion 14 are fully symmetrical about the fold line 16. Further, in the embodiment shown in FIG. 2, the lingerie cushion has rounded corners 31 to enhance the comfort thereof. In addition, in the embodiment shown in FIG. 3, the lingerie cushion has side curves 32 which are also symmetrical about the fold line 16.

Figure 4:
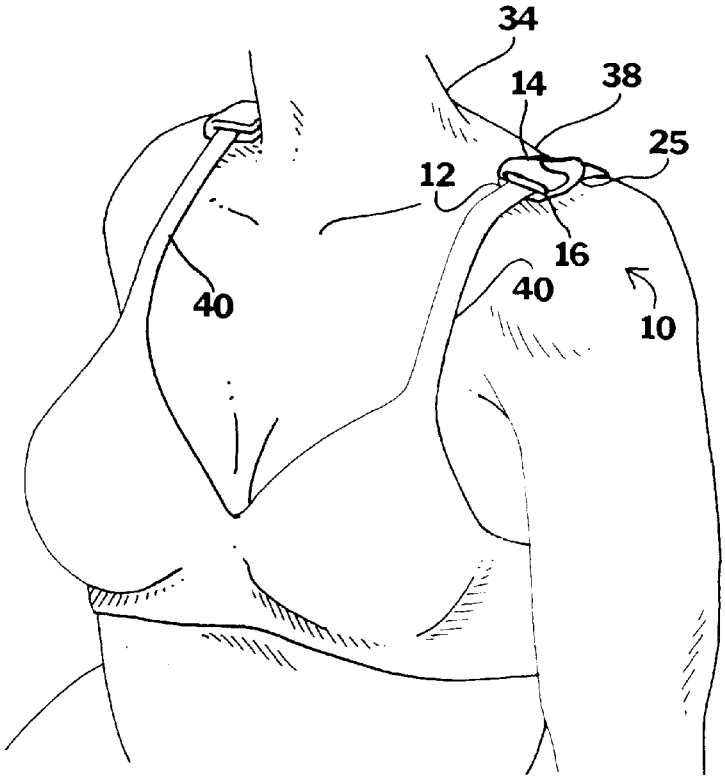
FIG. 4 is a diagrammatic perspective view, illustrating a preferred embodiment of the invention, in use.

FIG. 4 illustrates the preferred embodiment in use. A woman 34 is wearing a brassiere 36. The woman 34 has shoulders 38. The brassiere 36 has a pair of straps 40. A pair of lingerie cushions 10 are in use. One of the straps 40 extends through each of the lingerie cushions 10, such that the strap 40 extends along the fold line 16, rests upon the lower cushion 12, and is partially covered by the upper cushion 14. The extension section 25 continues over the shoulder 38, providing additional support and weight distribution area for the strap 40. Thus, although the upper portion 14 helps trap the strap within the cushion, the lower portion 12 cushions the strap 40. Therefore, in meeting these goals, according to the present invention, the lower portion 12 is maximized, while the upper portion 14 is minimized.

In conclusion, herein is presented a lingerie strap cushioning device which envelopes a lingerie shoulder strap, and increases the weight distribution area upon the shoulder, to enhance the comfort thereof.

What is claimed is:

1. A lingerie strap cushioning device, for use by a woman when wearing lingerie having shoulder straps, comprising:

an upper portion;

a lower portion;

a fold line between the upper portion and lower portion;

the upper portion and lower portion are normally coplanar but are selectively foldable with respect to each other to trap one of the straps therebetween;

the upper portion and lower portion having a bottom curve and a top curve, the bottom curve being symmetrical about the fold line so that when the upper portion is folded with respect to the lower portion along the fold line, the upper portion overlaps the lower portion along the bottom curve; the top curve extends between the upper portion and lower portion, intersecting the fold line at a point of intersection, said top curve is concave outward at the point of intersection.

2. The lingerie strap cushioning device as recited in claim 1, wherein the upper portion is folded to the lower portion, the top curve forms an extension section on the lower portion which is a section of the lower section that is not overlapped by the upper portion.

3. The lingerie strap cushioning device as recited in claim 2, wherein the upper portion and lower portion each comprise fastening device components which are selectively secured to each other when the upper portion is folded to the lower portion, to selectively secure the upper portion to the lower portion, and then to selectively release the upper portion from the lower portion.

4. The lingerie strap cushioning device as recited in claim 3, wherein the fastening device components are hook and loop fastener components.

* * * * *